US005085212A

United States Patent [19]

DeCosta

[11] Patent Number: 5,085,212

[45] Date of Patent: Feb. 4, 1992

[54] PORTABLE SOLAR TANNING BOX

[76] Inventor: Sandra D. DeCosta, 1535 Wapping Rd., Middletown, R.I. 02840

[21] Appl. No.: 698,101

[22] Filed: May 10, 1991

[51] Int. Cl.[5] ..... A61H 33/00

[52] U.S. Cl. ..... 128/372; 4/526; 4/585; 5/417; 5/420; 135/106

[58] Field of Search ..... 128/365-373; 135/106-113; 4/526-530, 585-587; 5/417-420, 201

[56] References Cited

U.S. PATENT DOCUMENTS

| | | | |
|---|---|---|---|
| 1,669,484 | 5/1928 | Mowry | 128/372 |
| 1,778,815 | 10/1930 | Scrivner et al. | 128/372 |
| 1,900,274 | 3/1933 | Brockie | 128/372 |
| 2,950,484 | 8/1960 | Jaffe | 4/587 |
| 2,981,256 | 4/1961 | Besnah | 128/372 |
| 3,023,753 | 3/1962 | Wheless | 128/372 |
| 3,050,067 | 8/1962 | Trafton | 128/372 |
| 3,498,587 | 3/1970 | Friedberg | 128/372 |
| 3,610,249 | 10/1971 | Baker et al. | 128/372 |
| 4,205,684 | 6/1980 | Lassy | 128/372 |
| 4,320,744 | 3/1982 | Fodor et al. | 128/372 |
| 4,520,835 | 6/1985 | Moeller | 135/109 |
| 4,785,486 | 11/1988 | Vlesturs | 4/587 |

FOREIGN PATENT DOCUMENTS

| | | | |
|---|---|---|---|
| 3535777 | 4/1987 | Fed. Rep. of Germany | 128/395 |
| 2178771 | 2/1987 | United Kingdom | 4/585 |

*Primary Examiner*—Edward M. Coven
*Assistant Examiner*—Mark S. Graham
*Attorney, Agent, or Firm*—Brady, O'Boyle & Gates

[57] ABSTRACT a foldable, portable solar tanning box of sun reflective fabric having a floor comprising plural hingedly connected floor panels, and end walls and side walls, all hingedly connected to the floor. Cooperating fasteners are secured to each of the end walls and adjacent portions of the side walls for holding the side and end walls in the erected position. The fasteners on each of the end walls cooperate with each other to hold the box in the folded position. By this construction and arrangement, the fasteners on the end walls are employed for not only holding the box in the erected position but also for holding the box in the folded position.

9 Claims, 3 Drawing Sheets

PORTABLE SOLAR TANNING BOX

BACKGROUND OF THE INVENTION

Various sun tanning apparatus have been proposed to facilitate the tanning of portions of the sun bather's body not directly exposed to the sun's rays. This type of apparatus usually includes some type of reflective surface either held by the sun bather, or constructed and arranged to support the sun bather in either a sitting or reclining position. U.S. Pat. No. 3,050,067, dated Aug. 21, 1962, discloses the latter apparatus, wherein a foldable, embossed, sun reflecting fabric is constructed to form a rectangular assembly having a fabric sheet floor and interconnected fabric side and end walls. Sleeves are provided on the side walls through which pointed stakes are driven into the ground to hold the assembly in erected position. In use, the sun bather can either sit or recline in the rectangular assembly, and the embossed reflective fabric will reflect sun rays to portions of the sun bather's body not directly exposed to the sun. While the sun tan device disclosed in the aforementioned patent has been satisfactory for its intended use, its construction necesitated the sun bather to perform many operations in the setting up and dismantling of the assembly. For instance, the flexibility of the reflective fabric required not only the pointed stakes driven into the ground for holding the side and end walls in the erected position, but also additional struts or rods insertable into the upper marginal edge portions of the side and end walls; thus, before the fabric could be folded and rolled up for storage, it was necessary to remove the pointed stakes and the struts from the fabric.

SUMMARY OF THE INVENTION

After considerable research and experimentation, the portable solar tanning box of the present invention has been devised an in improvement on the tanning apparatus disclosed in the aforementioned patent, and comprises, essentially, a sun reflective fabric having cushioned bottom and end walls. Cooperating quick connect and disconnect fasteners are provided on each of the end walls and adjacent portions of the side walls for holding the side and end walls in the erected position, and the quick connect and disconnect fasteners on one end wall cooperate with the quick connect and disconnect fasteners on the other end wall to hold the walls in the folded position for easy storage and carrying. By this construction and arrangement, the quick connect and disconnect fasteners on the end walls are employed for not only holding the walls in the erected position but also in the folded, stored, and carrying position.

The side walls are provided with sleeves through which pointed stakes are driven therethrough into the ground, and a storage pocket is provided on one end wall for holding the stakes, when not in use. Another pocket is provided in the other end wall for storing a pillow or other personal items of the sun bather.

The cushioned bottom and end walls include hingedly connected panels so that they may be folded and unfolded very easily and quickly. When folding the box, the fabric side walls are first folded inwardly to overlap the bottom wall panels, and then the hingedly connected panels are alternately folded upon each other in a pleated or accordion fashion, whereby in the folded position the plural bottom wall panels and fabric side walls are sandwiched between each of the end wall panels which are fastened together by the quick connect and disconnect fasteners to thereby hold the folded box in a compact manner, with all of the wall panels in closely adjacent vertical planes.

A shoulder strap is provided to facilitate the carrying of the folded box by the sun bather.

DESCRIPTION OF THE PREFERRED EMBODIMENT

Figure 1:
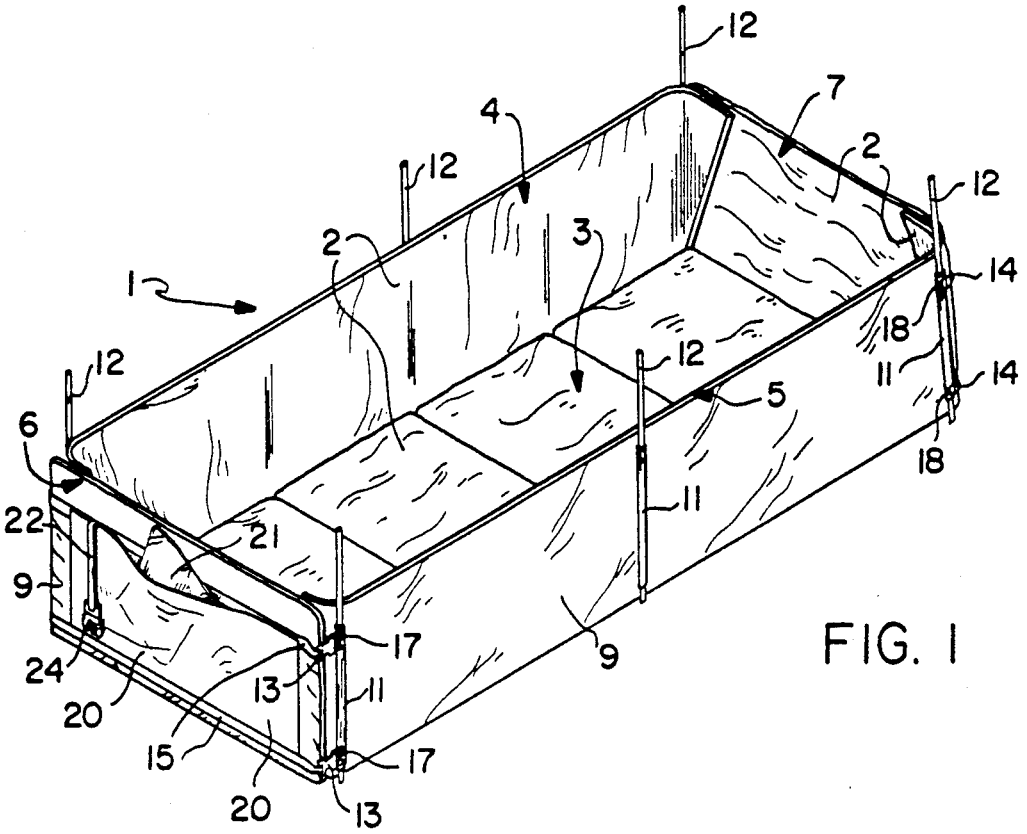
FIG. 1 is a perspective view of the portable solar tanning box of the present invention in the erected position.
Figure 2:
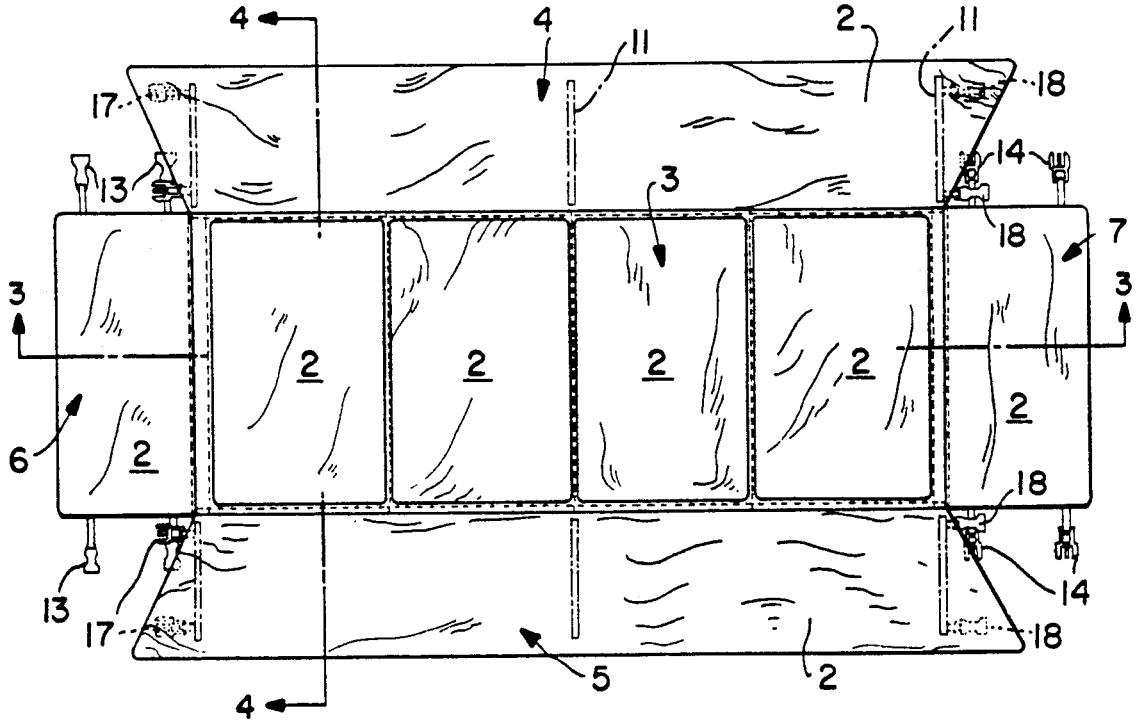
FIG. 2 is a top plan view of the box showing the side and end walls of the box being folded outwardly to be substantially coextensive with the bottom wall.
Figure 3:
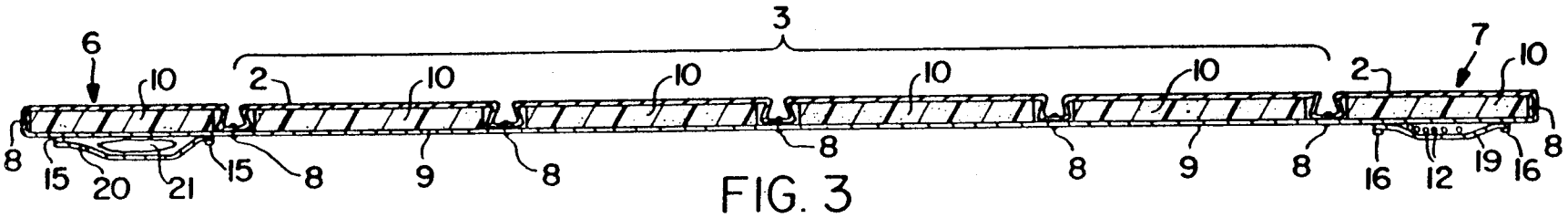
FIG. 3 is a longitudinal cross-section view taken along line 3—3 of FIG. 2.
Figure 4:
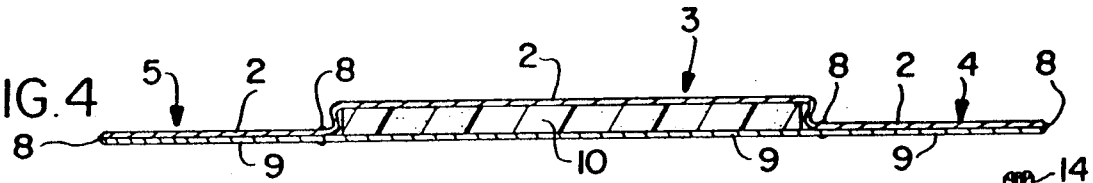
FIG. 4 is a transverse cross-section view taken along line 4—4 of FIG. 2.

Referring to the drawings and more particularly to FIGS. 1 and 2, the portable solar tanning box 1 of the present invention comprises a foldable, embossed sun reflecting fabric 2 constructed to form a rectangular assembly having a floor 3 and interconnected side walls 4 and 5 and end walls 6 and 7. The embossed, sun reflecting fabric 2 is a reflective laminated fabric such as of a type manufactured by Bruin Plastics Company, Inc. of Glendale, R.I., under the trademark Energy Shield, and preferably having a weight of 18 oz. or 10 oz. The reflective laminated fabric, as shown in FIGS. 3 and 4, is stitched as at 8 to a flexible, rot resistant, tear resistant, waterproof, high tensile strength, Nylon fabric 9 which forms the outer wall surface of the floor, side walls, and end walls of the tanning box 1.

The portions of the reflecting fabric 2 stitched at 8 to the portion of the fabric 9 forming the floor 3, and end walls 6 and 7 of the tanning box, are stitched in such a manner as to provide pockets for receiving foamed plastic panels or pads 10, whereby the floor 3 and end walls 6 and 7 of the tanning box are cushioned and hinged together at adjoining stitching 8. The floor 3 is preferably formed by four hinged panel sections, as shown, with each panel section having a separate interior foamed plastic panel or pad 10. The foamed plastic panels or pads 10 in the floor panel sections and end walls are of the yieldable cushion type, to provide a comfortable, padded, somewhat flexible floor on which to lie, which is not hard or rigid.

Figure 5:
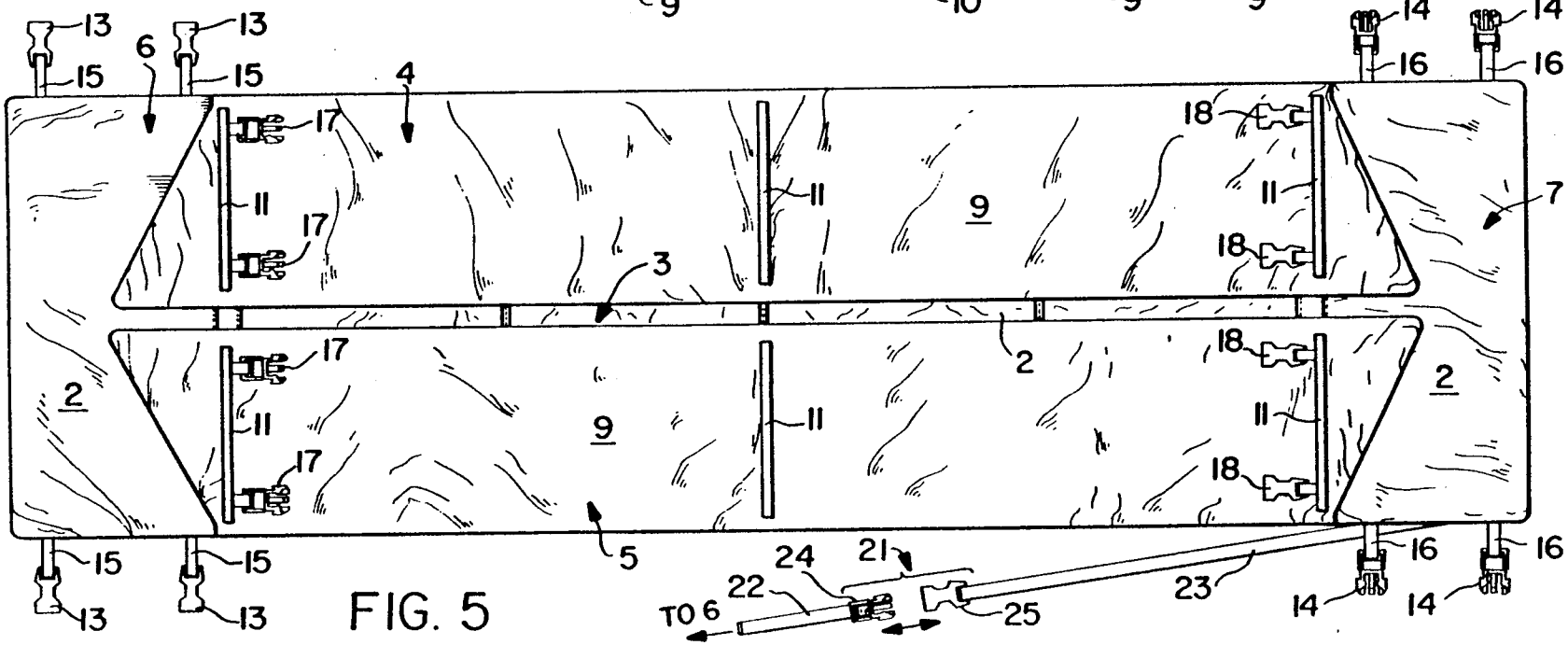
FIG. 5 is a top plan view of the box showing the side walls folded inwardly to overlap the bottom wall panels, and the end wall panels folded outwardly preparatory to folding the walls into the stored position.

As will be seen in FIGS. 1 and 5, the Nylon fabric 9 on the outer surfaces of side walls 4 and 5 are provided with fabric sleeves 11 stitched thereto through which spiked stakes 12 extend into the ground to hold the side walls 4 and 5 in the erected position, as shown in FIG. 1. In use, the stakes 12 would be pushed into the ground so their tops would be substantially flush with the top edges of the side walls.

In order to hold the end walls 6 and 7 in the erected position, two pairs of quick connect and disconnect fasteners 13 and 14, FIGS. 2 and 5, are secured to a respective pair of belts 15, 16 extending transversely across and stitched to the outer fabric 9 on the respective end walls 6 and 7. These fasteners cooperate with two pairs of respective mating fasteners 17 and 18 secured to the sleeves 11 at each end of the side walls 4 and 5 adjacent the end walls 6 and 7, as shown in FIGS. 1, 2, and 5. The preferred quick connect and disconnect fastener is a type readily available, manufactured of plastics, and designated "Side Squeeze", manufactured by National Molding of Farmingdale, N.Y. The male fastener portions 14 and 17 are molded so the opposite outer prongs are resiliently yieldable and slide on to the female fastener portions 13 and 18 and click into locking engagement with recesses in opposite sides thereof. To release the fasteners, the exposed prongs in the recesses are pressed inwardly toward each other to release them from the recesses and the fastener portions are pulled axially apart to thus quickly disconnect them from each other.

Figure 6:
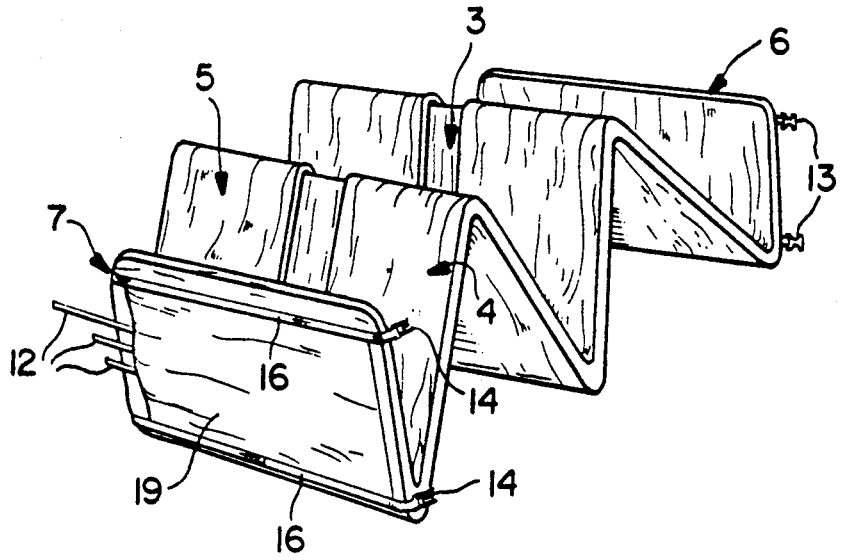
FIG. 6 is a perspective view showing the end wall panels, bottom wall panels and overlapped side walls being oriented to the folded position.

To fold up the tanning box, after removing the stakes 12, the side walls 4 and 5 are folded inwardly, as shown in FIG. 5, to be superimposed on the floor 3, and then the end walls 6 and 7 and the four panel section of floor 3, with associated side walls 4 and 5, are folded back and forth, as shown in FIG. 6, in a pleated or accordion fashion, upon each other, the stitched portions 8 providing hinged connections to facilitate the folding of the panels relative to each other. In the compact folded position of FIGS. 7, 8, and 9, the end walls 6 and 7 are vertically disposed on the outside while the floor panel sections and associated folded side walls are vertically disposed between them.

Figure 7:
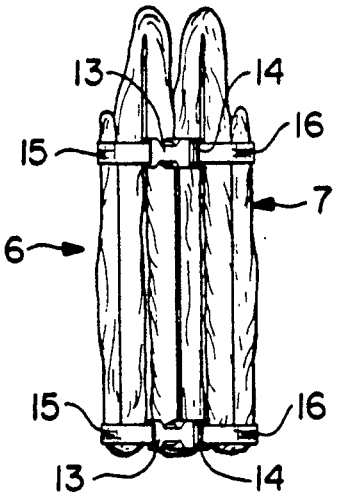
FIG. 7 is an end elevational view showing the tanning box in the folded, stored position.
Figure 8:
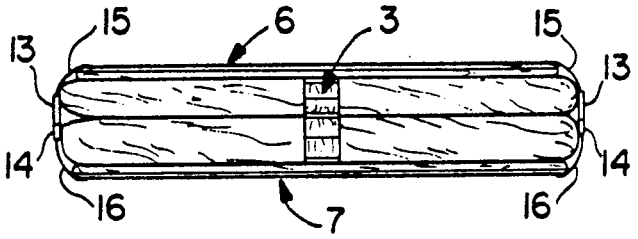
FIG. 8 is a top plan view of the box of FIG. 7 in the folded position.

To hold the box in the folded position, as shown in FIG. 7, the respective fasteners 13 and 14 on each end wall 6 and 7 are connected together. By this construction and arrangement, the fasteners 13 and 14 which are employed to hold the box in the erected position, as shown in FIG. 1, by coupling with fasteners 17 and 18, respectively, are also employed to hold the box in the folded position as shown in FIG. 7, by coupling with each other.

Figure 9:
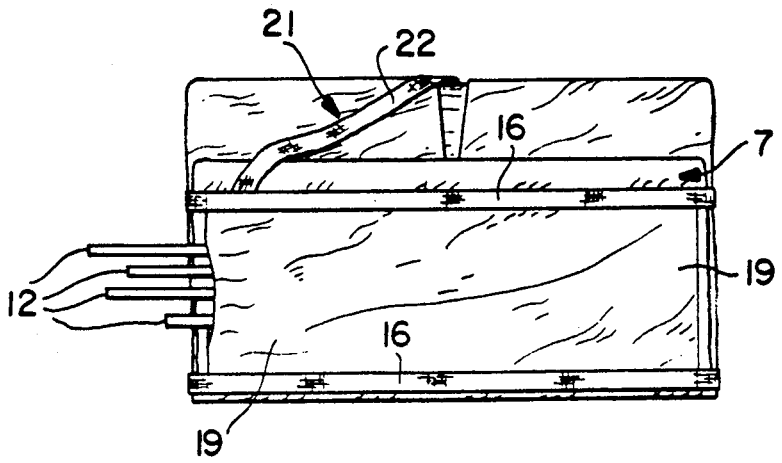
FIG. 9 is a side elevational view of the box of FIGS. 7 and 8 illustrated in the folded position for storage and carrying.

To complete the structure of the tanning box, a pocket 19 is provided on the end wall 7, as shown in FIGS. 3, 6, and 9, for storing the stakes 12. This pocket may be closed, for example, with a Velcro fastener. Another pocket 20, having a similar closure, is provided on the other end wall 6, as shown in FIGS. 1 and 3, for storing a pillow 21, or other personal items of the sun bather. To facilitate carrying the folded box, a shoulder strap 21, FIG. 5, is provided having a pair of strap sections 22 and 23 having their free ends connected together by a pair of cooperating quick connect and disconnect fasteners 24, 25, and their opposite ends stitched or otherwise secured to the end walls 6 and 7, respectively. When the box is in the erected position, as shown in FIG. 1, the fasteners 24 and 25 are disconnected, and thin associated strap sections 22 and 23 can be tucked into the respective pockets 19 and 20.

From the above description, it will be readily appreciated by those skilled in the art that the portable solar tanning box of the present invention is easily erected for use by a sun bather, and easily folded for storage and carrying, and by the construction and novel dual use arrangement of the cooperating fasteners 13, 14, 17 and 18 no additional components are required to be employed for holding the box in the erected or folded position.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. In an foldable, portable solar tanning box of sun reflective fabric having a floor and a pair of side and a pair of end walls hingedly connected to the floor, the improvement comprising, cooperating fastener means secured to each of the end walls and adjacent portions of the side walls for holding the side and end walls in an erected position, the fastener means on one end wall cooperating to fastener with the fastener means on the other end wall for holding the fabric in a folded position, whereby the fastener means on the end walls are employed for not only holding the box in the erected position but also for holding the box in the folded position.

2. A foldable, portable tanning box according to claim 1, wherein sleeves are mounted on the side walls, and including removable, pointed stakes extending through said sleeves and adapted to extend into the ground for holding the box on the ground in the erected position.

3. A foldable, portable tanning box according to claim 2, wherein a pocket is provided on one end wall for storing said stakes when the fabric is in the folded position.

4. A foldable, portable tanning box according to claim 3, wherein another pocket is provided in the other end wall for storing personal items of a sun bather.

5. A foldable, portable tanning box according to claim 1, wherein the reflective fabric is stitched to a flexible, waterproof fabric to form an outer wall surface of the tanning box.

6. A foldable, portable, tanning box according to claim 5, wherein the reflective fabric comprising the floor and end wall is stitched to the waterproof fabric to form pockets between the fabrics with foamed plastic panels contained in said pockets, whereby the floor and end walls of the box are cushioned.

7. A foldable, portable tanning box according to claim 6, wherein portions cf the stitching extend transversely of the floor and of lower edge portions of the end walls provide hinges, whereby the floor and end walls can be alternately folded in a pleated, accordion fashion.

8. A foldable, portable tanning box according to claim 7, wherein the side walls of the box are foldable inwardly to overlap the floor, whereby in the folded position the floor and side walls are sandwiched between each of the end walls.

9. A foldable, portable tanning box according to claim 1, wherein a shoulder strap is connected between the end walls to facilitate carrying the tanning box in the folded position.

* * * * *